US011037483B2

(12) United States Patent
Ji

(10) Patent No.: US 11,037,483 B2
(45) Date of Patent: Jun. 15, 2021

(54) METHOD OF ADJUSTING GAMMA VALUE OF DISPLAY PANEL BY AUTOMATIC JUDGEMENT, DEVICE, AND DISPLAY APPARATUS

(71) Applicants: CHONGQING HKC OPTOELECTRONICS TECHNOLOGY CO., LTD., Chongqing (CN); HKC CORPORATION LIMITED, Shenzhen (CN)

(72) Inventor: Feilin Ji, Chongqing (CN)

(73) Assignees: CHONGQING HKC OPTOELECTRONICS TECHNOLOGY CO., LTD., Chongqing (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/042,485

(22) PCT Filed: Dec. 18, 2018

(86) PCT No.: PCT/CN2018/121641
§ 371 (c)(1),
(2) Date: Sep. 28, 2020

(87) PCT Pub. No.: WO2020/062615
PCT Pub. Date: Apr. 2, 2020

(65) Prior Publication Data

US 2021/0012700 A1 Jan. 14, 2021

(30) Foreign Application Priority Data

Sep. 30, 2018 (CN) ..... 201811170766.9

(51) Int. Cl.
*G09G 3/20* (2006.01)
*G09G 3/34* (2006.01)

(52) U.S. Cl.
CPC ..... *G09G 3/2007* (2013.01); *G09G 3/3406* (2013.01); *G09G 2320/0673* (2013.01); *G09G 2360/16* (2013.01)

(58) Field of Classification Search
None
See application file for complete search history.

(56) References Cited

U.S. PATENT DOCUMENTS 5,910,796 A * 6/1999 Gormish ..... G06F 3/04897 345/600
6,700,561 B1 * 3/2004 Christensen, Jr. ... G09G 3/3611 345/204

(Continued)

FOREIGN PATENT DOCUMENTS

CN 1845232 A 10/2006
CN 101211035 B 5/2010

(Continued)

OTHER PUBLICATIONS

First Office Action in counterpart Chinese Application No. 201811170766.9, dated Oct. 31, 2019.

(Continued)

*Primary Examiner* — Chad M Dicke
(74) *Attorney, Agent, or Firm* — Westbridge IP LLC

(57) ABSTRACT

An adjusting method for a gamma value of a display panel includes: acquiring a gamma value and panel information, after the gamma value of the display panel is adjusted; generating an adjusting file in a preset format according to the gamma value and the panel information; and storing the adjusting file to a preset storing path, to allow to extract the adjusting file from the storing path for gamma judgment. The present application further discloses an adjusting device (Continued)

for the gamma value of the display panel and a display apparatus.

19 Claims, 4 Drawing Sheets

(56) References Cited

U.S. PATENT DOCUMENTS

2002/0163527 A1* 11/2002 Park ..... G09G 5/003 345/594
2005/0140584 A1* 6/2005 Kim ..... G09G 3/2935 345/60
2006/0044242 A1* 3/2006 Park ..... G09G 3/3648 345/89
2006/0114211 A1* 6/2006 Fushimi ..... G09G 3/3611 345/98
2006/0132867 A1* 6/2006 Sugiyama ..... G09G 5/003 358/504
2006/0227082 A1* 10/2006 Ogata ..... G09G 3/3291 345/76
2006/0232599 A1* 10/2006 Lin ..... G09G 5/02 345/589
2006/0274217 A1* 12/2006 Bae ..... H04N 9/69 348/791
2006/0280360 A1* 12/2006 Holub ..... H04N 17/045 382/162
2007/0109245 A1* 5/2007 Hwang ..... G09G 3/006 345/98
2007/0120792 A1* 5/2007 Sasaki ..... G09G 3/3696 345/89
2012/0098848 A1* 4/2012 Choi ..... G09G 3/20 345/589
2012/0320098 A1* 12/2012 Kwak ..... G09G 3/2003 345/690
2014/0184654 A1* 7/2014 Lee ..... G09G 3/3233 345/690
2014/0307105 A1* 10/2014 Lin ..... H04N 9/69 348/191
2014/0340580 A1* 11/2014 Nakamura ..... G09G 5/06 348/655
2016/0171939 A1* 6/2016 Na ..... G09G 3/20 345/690
2018/0130394 A1* 5/2018 Hwang ..... G09G 3/3233
2019/0265937 A1* 8/2019 Kato ..... G06F 3/14

FOREIGN PATENT DOCUMENTS

CN 103268745 A 8/2013
CN 103810963 A * 5/2014 ..... G09G 3/006
CN 104113751 A 10/2014
CN 104680962 A 6/2015
CN 105244007 A 1/2016
CN 106652864 A * 5/2017
CN 107045863 A 8/2017
CN 107239522 A 10/2017
CN 107483907 A 12/2017
CN 107562835 A 1/2018
CN 108322739 A 7/2018
JP H1093984 A 4/1998

OTHER PUBLICATIONS

International Search Report and Written Opinion in corresponding PCT Application No. PCT/CN2018/121641, dated Jul. 4, 2019.
Second Office Action in counterpart Chinese Application No. 201811170766.9, dated Mar. 23, 2020.
Third Office Action in counterpart Chinese Application No. 201811170766.9, dated Jul. 22, 2020.

* cited by examiner

METHOD OF ADJUSTING GAMMA VALUE OF DISPLAY PANEL BY AUTOMATIC JUDGEMENT, DEVICE, AND DISPLAY APPARATUS

CROSS REFERENCE TO RELATED APPLICATION

The present application is the National Stage of International Application No. PCT/CN2018/121641, filed on Dec. 18, 2018, which claims the benefit of Chinese patent application filed with the National Intellectual Property Administration on Sep. 30, 2018, with the application number 201811170766.9 and Title "Adjusting method, adjusting device for gamma value of display panel, and display apparatus", the entire contents of which are hereby incorporated by reference.

TECHNICAL FIELD

The present application relates to the technical field of display panel, in particular to an adjusting method and an adjusting device for gamma value of a display panel, and a display apparatus.

BACKGROUND

At present, liquid crystal televisions are equipped with liquid crystal screens from different manufacturers. The liquid crystal screens can be divided into RGB screens and RGBW screens according to the number of light filters for an individual pixel. These two kinds of screens have a great difference in synthesis algorithm of the white light as well as brightness loss after and gamma curve adjustment. In addition, various combined total liquid crystal modules from various manufacturers have a great difference in in original screen brightness and original color temperature, which is mainly brought about from the differences in OC, the transmittance, material of color filter film, the lamp bead process of LED backlight, chromatography, and membrane. Therefore, the gamma curve of the ex-factory display screen needs to be adjusted according to the characteristics of each display screen.

It is always two separated processes regarding the gamma adjustment and the gamma judgment, in which the latter process of gamma judgement is based on the adjusted gamma curve obtained by the previous process of gamma adjustment. However, because these two processes are often separated, it is almost unlikely to automatically extract the gamma curve for gamma judgment, and the user is required to manually input the gamma curve for further judgment, lowering the efficiency of factory setting of the display panel.

SUMMARY

The main purpose of the present application is to provide an adjusting method, an adjusting device for gamma value of the display panel, and a display apparatus, aiming at increasing the factory setting efficiency of the display panel in the prior art.

To achieve the above object, the present application provides an adjusting method for a gamma value of a display panel, including:

acquiring a gamma value and panel information, after the gamma value of the display panel is adjusted;

generating an adjusting file in a preset format according to the gamma value and the panel information; and storing the adjusting file to a preset storing path, to allow to extract the adjusting file from the storing path for gamma judgment.

Optionally the adjusting file in the preset format is a text file named after panel identification and an adjusting time point.

Optionally after storing the adjusting file to a preset storing path, the method includes:

extracting the adjusting file of the display panel from the preset storing path;

acquiring the gamma value in the adjusting file; and judging whether the gamma value is in a preset gamma value range, to perform the gamma judgment.

Optionally, extracting the adjusting file of the display panel from the preset storing path, includes;

acquiring panel information of the display panel to be judged; and extracting the adjusting file correspondingly according to the acquired panel information.

Optionally, after extracting the adjusting file of the display panel from the preset storing path, the method further includes:

outputting a prompt message indicating that the adjusting file does not exist, when the adjusting file is not obtained.

Optionally, after extracting the adjusting file of the display panel from the preset storing path, the method further includes:

adding an "already-called" identification to the extracted adjusting file.

Optionally, prior to the operation of acquiring a gamma value and panel information, after the gamma value of the display panel is adjusted, the method further includes:

controlling the display panel to output an image of each preset gray scale;

acquiring brightness corresponding to the image of each preset gray scale, and calculating a gamma value corresponding to each preset gray scale according to the acquired brightness;

generating a gamma curve of the display panel according to the calculated gamma value; and acquiring a gamma value of the gamma curve.

Optionally, acquiring a gamma value of the gamma curve, includes:

acquiring an average gamma value in a preset gray scale range; and taking the average gamma value as the gamma value of the gamma curve.

Optionally, controlling the display panel to output an image of each preset gray scale, includes:

taking a detecting point for each preset gray scale interval, and outputting the image of the gray scale corresponding to each detecting point.

Optionally, generating a gamma curve of the display panel according to the calculated gamma value, includes:

connecting the calculated gamma value to form a curve; and smoothing an inflection point on the curve to obtain the gamma curve.

Optionally, after generating a gamma curve of the display panel according to the calculated gamma value, the method further includes:

adjusting an output voltage of backlight, when an error exists between the gamma curve and a standard gamma curve.

Optionally, the adjusting method for gamma value of the display panel further includes:

acquiring a judgment result and the panel information of the display panel of which the gamma value is judged, after the gamma judgment of the display panel is performed; and associating and storing the judgment result and the panel information.

Optionally, after acquiring a judgment result and the panel information of the panel of which the gamma value is judged, the method further includes:

sending the judgment result and the panel information to a server.

Optionally, the panel information includes a panel identification, models of the display panel and/or an adjusting time point.

Optionally, the adjusting file is categorized to store by models of the display panel.

Optionally, a preset number of the adjusting file is deleted based on a storing time point, when remaining storage capacity regarding the storing path is less than a preset threshold value;

or, a preset number of the adjusting file is deleted at a preset time interval.

In addition, to achieve the above object, the present application further provides an adjusting device for a gamma value of a display panel, including at least one processor and a memory, in which the memory stores computer executable instructions executable by the at least one processor, and when the computer executable instructions are executed by the at least one processor, operations are executed in the following circuit are executed:

an acquiring circuit, configured to acquire a gamma curve and panel information, after the gamma value of the display panel is adjusted;

a generating circuit, configured to generate an adjusting file in a preset format according to the gamma curve and the panel information; and a storing circuit, configured to store the adjusting file to a preset storing path, to allow to extract the adjusting file from the storing path for gamma judgment.

Optionally, when the computer executable instructions are executed by the at least one processor, operations are further executed in the following circuit:

a file extracting circuit, configured to extract the adjusting file of the display panel from the preset storing path;

a gamma value acquiring circuit, configured to acquire the gamma value in the adjusting file; and a judging circuit, configured to judge whether the gamma value is in a preset gamma value range, to perform the gamma judgment.

In addition, in order to achieve the above object, the present application further provides a display apparatus, including at least one processor and a memory, in which the memory stores computer executable instructions executable by the at least one processor, and when the computer executable instructions are executed by the at least one processor, operations are executed in the following circuit:

an outputting circuit, configured to control the display panel to output an image of each preset gray scale;

an acquiring circuit, configured to acquire brightness corresponding to the images of each preset gray scale;

a calculating circuit, configured to calculate a gamma value according to the brightness; and a comparing circuit, configured to compare the calculated gamma value with a preset gamma value range to determine whether a gamma value adjustment is correct, in which when the calculated gamma value is within the preset gamma value range, the gamma value adjustment is determined to be correct.

Optionally, when the computer executable instructions are executed by the at least one processor, operations are further executed in the following circuit:

a file extracting circuit, configured to extract the adjusting file of the display panel from the preset storing path;

a gamma value acquiring circuit, configured to acquire the gamma value in the adjusting file; and a judging circuit, configured to judge whether the gamma value is in a preset gamma value range, to perform the gamma judgment.

According to the adjusting method, adjusting device for the gamma value of the display panel and display apparatus which are provided by the present application, after the gamma value of the display panel is adjusted, an adjusting file in a preset format is directly generated according to the gamma value and panel information. And the adjusting file is stored to a preset storing path. When gamma judgment is performed, the gamma value is directly extracted from adjusting file and the preset storing path for judgment. A user is not required to manually input the gamma value for the gamma judgment, so that the factory setting efficiency of the display panel is improved.

The implementation, functional characteristics and advantages of the present application will be further described with reference to the attached drawings in combination with embodiments.

DETAILED DESCRIPTION OF THE EMBODIMENTS

It should be understood that the specific embodiments described herein are only for illustrative purpose and are not intended to limit the present application.

The main solution to the embodiments of the present application is as follows:

acquiring a gamma value and panel information, after the gamma value of the display panel is preliminarily adjusted;

generating an adjusting file in a preset format according to the gamma value and the panel information;

storing the adjusting file to a preset storing path, to allow to extract the adjusting file from the storing path for gamma judgment.

It is two separated processes of gamma adjustment and gamma judgment in the prior art. Gamma judgment is based on the adjusted gamma curve obtained by gamma adjustment. However, because these two processes are often separated, it is impossible to automatically extract the gamma curve for gamma judgment, and the user is required to manually input the gamma curve for further judgment, lowering the efficiency of factory setting of the display panel.

According to the technical solution of the present application, after the gamma value of the display panel is preliminarily adjusted, an adjusting file in a preset format is directly generated according to the gamma value and panel information. And the adjusting file is stored to a preset storing path. When gamma judgment is performed, the gamma value is directly extracted from adjusting file and the preset storing path for judgment. A user is not required to manually input the gamma value for the gamma judgment, so that the factory setting efficiency of the display panel is improved.

Figure 1:
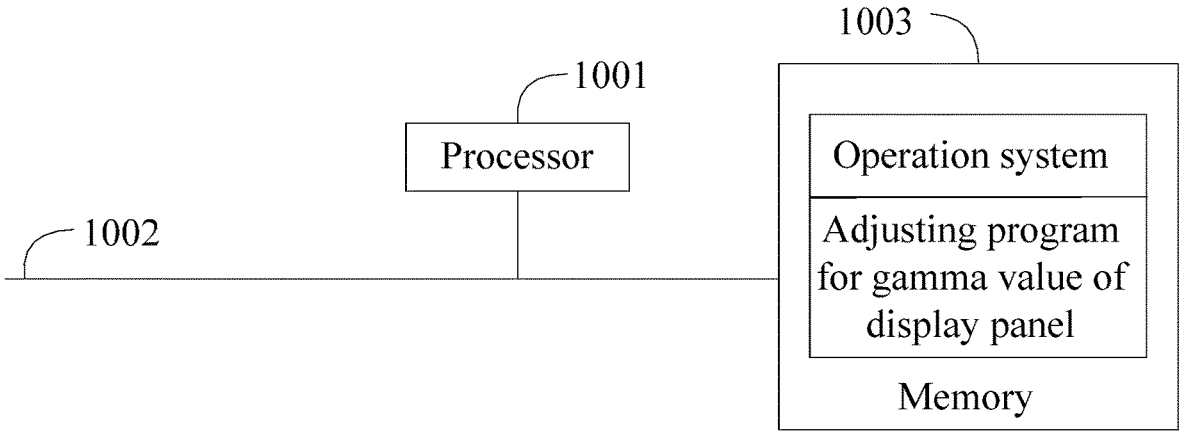
FIG. 1 is a system schematic diagram of the hardware operating environment structure according to some embodiments of the present application.

As shown in FIG. 1, which is a system schematic diagram of the hardware operating environment structure according to some embodiments of the present application The device of the embodiment of the present application can be a display panel or other terminals, such as a computer. When the terminal of the embodiment is a computer, the computer communicates with the display panel through a data line or a wireless mode to realize the gamma value adjustment.

As shown in FIG. 1, the device may include a processor 1001, a communication bus 1002, and a memory 1003. In which, the communication bus 1002 is configured to implement connection and communication between these components. The memory 1003 may be a high-speed RAM memory or a non-volatile memory such as a disk memory. The memory 1003 may alternatively be a storage device independent of the aforementioned processor 1001, It would be understood by those skilled in the art that the terminal shown in FIG. 1 does not constitute a limitation to the terminal, which may include more or fewer components than shown, or some components may be combined, or different components arranged.

As shown in FIG. 1, the memory 1003 as a storage medium may include an operating system, and an adjusting program for the gamma value of the display panel.

In the terminal shown in FIG. 1, the processor may be configured to call an adjusting program for the gamma value of the display panel stored in the memory 1003, and execute the following operations:

acquiring a gamma value and panel information, after the gamma value of the display panel is preliminarily adjusted;

generating an adjusting file in a preset format according to the gamma value and the panel information; and storing the adjusting file to a preset storing path, to allow to extract the adjusting file from the storing path for gamma judgment.

Optionally, the processor may be configured to call an adjusting program for the gamma value of the display panel stored in the memory 1003, and execute the following operations:

extracting the adjusting file of the display panel from the preset storing path;

acquiring the gamma value in the adjusting file; and judging whether the gamma value is in a preset gamma value range, to perform the gamma judgment.

Optionally, the processor may be configured to call an adjusting program for the gamma value of the display panel stored in the memory 1003, and execute the following operations:

acquiring panel information of the display panel to be judged; and extracting the adjusting file correspondingly according to the acquired panel information.

Optionally, the processor may be configured to call an adjusting program for the gamma value of the display panel stored in the memory 1003, and execute the following operations:

acquiring a judgment result and the panel information of the display panel of which the gamma value is judged, after the gamma judgment of the display panel is performed; and associating and storing the judgment result and the panel information.

Optionally, the processor may be configured to call an adjusting program for the gamma value of the display panel stored in the memory 1003, and execute the following operations:

sending the judgment result and the panel information to a server.

Optionally, the processor may be configured to call an adjusting program for the gamma value of the display panel stored in the memory 1003, and execute the following operations:

controlling the display panel to output an image of each preset gray scale;

acquiring brightness corresponding to the image of each preset gray scale, and calculating a gamma value corresponding to each preset gray scale according to the acquired brightness; and generating a gamma curve of the display panel according to the calculated gamma value.

Optionally, in some embodiments, acquiring a gamma value of the gamma curve, includes:

acquiring an average gamma value in a preset gray scale range; and taking the average gamma value as the gamma value of the gamma curve.

Figure 2:
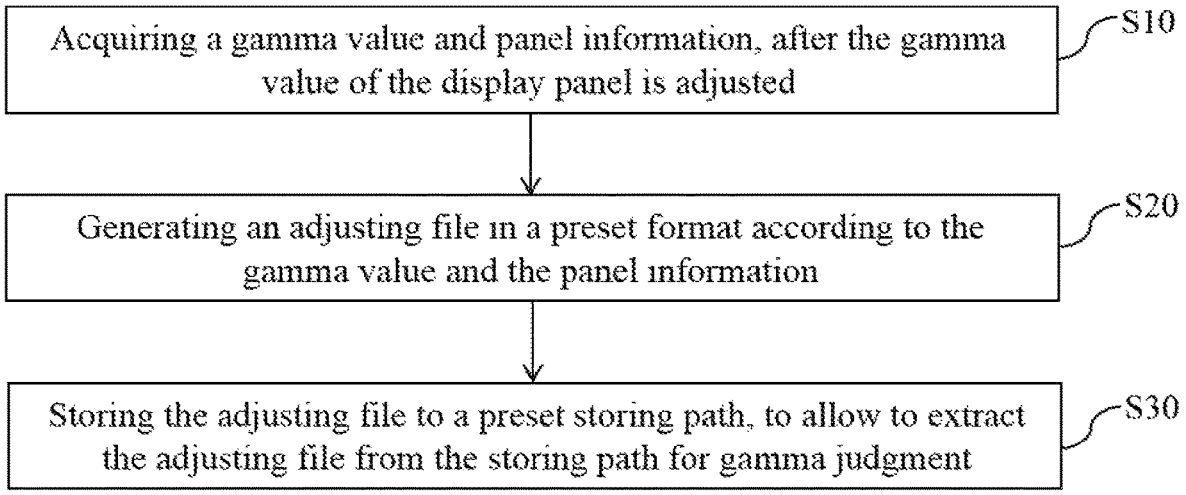
FIG. 2 is a flow chart of an adjusting method for a gamma value in some embodiments of the present application.

Referring to FIG. 2, some embodiments of the adjusting method for the gamma value of the display panel is proposed in the present application. In some embodiments, the adjusting method for the gamma value of the display panel includes:

Step S10, acquiring a gamma value and panel information, after the gamma value of the display panel is preliminarily adjusted.

The panel information may include a panel identification such as an ID (identification) of the panel or models of the display panel, etc. The panel identification may be obtained by scanning a graphic code (such as a QR code or a bar code) on the display panel, or may be manually input by a tester. It can be understood that the panel information may further include the adjusting time point of the panel.

Step S20, generating an adjusting file in a preset format according to the gamma value and the panel information.

The adjusting file in a preset format can be a text file named after the panel identification and the adjusting time point. The gamma value can be obtained by reading the text file. Naming the adjusting file through the panel information and adjusting time point can quickly obtain the adjusting file corresponding to the display panel currently being judged through the names of the adjusting file. The text file can be in TXT format.

Step S30, storing the adjusting file to a preset storing path, to allow to extract the adjusting file from the storing path for gamma judgment.

The stored adjusting files can be stored sequentially according to the storage time or classified according to the model of the display panel, and the stored folder can be named according to the model. When extracting the adjusting files, the model information of the display panel can be directly obtained, the corresponding storage folder can be obtained according to the model information, and the corresponding adjusting files can be obtained according to the panel information in the folder.

A preset number of the adjusting file can be deleted based on a storing time point, when remaining storage capacity regarding the storing path is less than a preset threshold value; or, a preset number of the adjusting file can be deleted at a preset time interval.

According to the adjusting method provided by some embodiments of the present application, after the gamma value of the display panel is preliminarily adjusted, an adjusting file in a preset format is directly generated according to the gamma value and panel information. And the adjusting file is stored to a preset storing path. When gamma judgment is performed, the gamma value is directly extracted from adjusting file and the preset storing path for judgment. A user is not required to manually input the gamma value for the gamma judgment, so that the factory setting efficiency of the display panel is improved.

Figure 3:
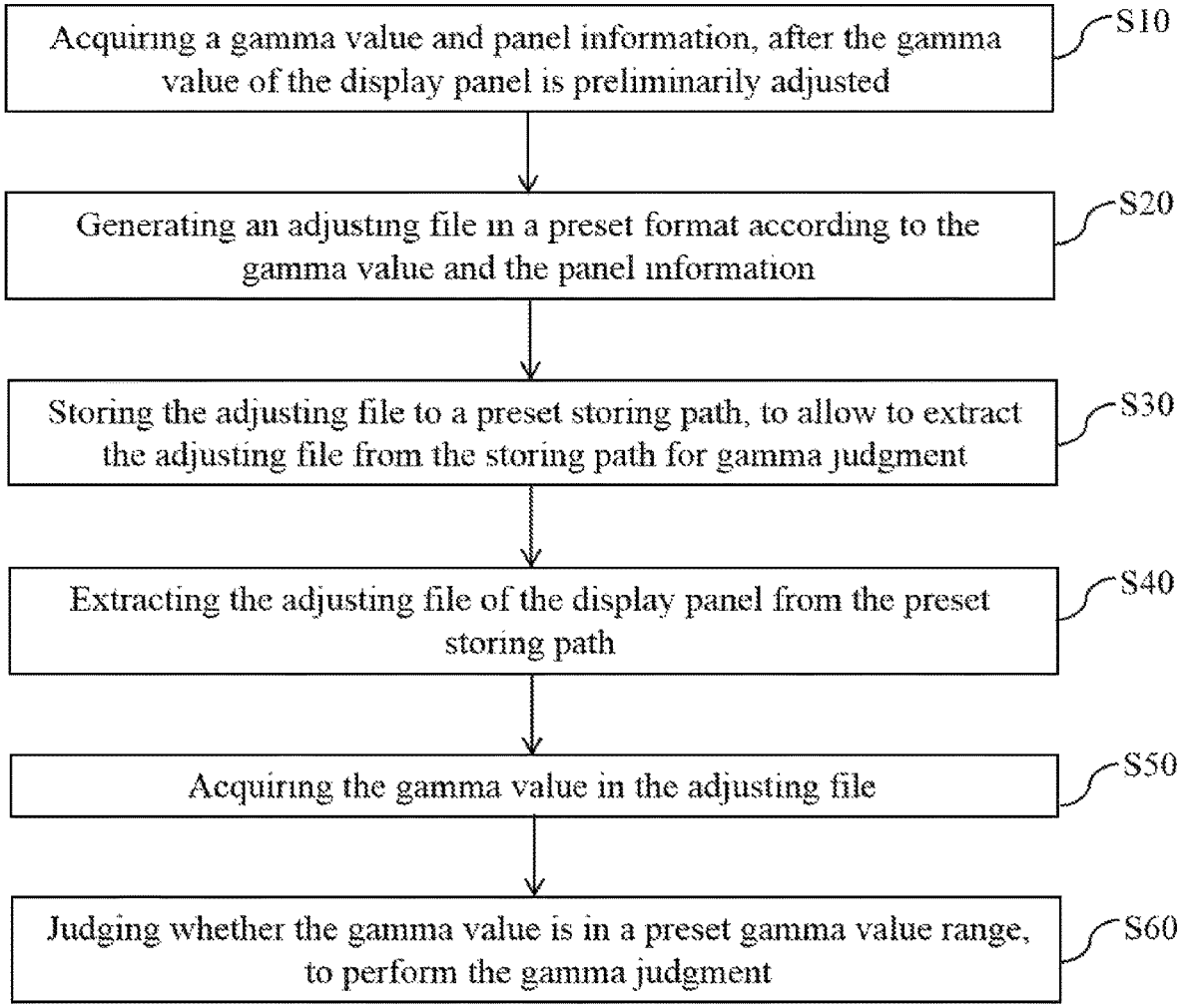
FIG. 3 is a flow chart of an adjusting method for a gamma value in some other embodiments of the present application.

Optionally, in some embodiments, FIG. 3 is referred to. Some other embodiments of the adjusting method for the gamma value of the panel are proposed. In some embodiments, after step S30, the method further includes:

Step S40, extracting the adjusting file of the display panel from the preset storing path.

Step S50, acquiring the gamma value in the adjusting file.

Step S60, judging whether the gamma value is in a preset gamma value range, to perform the gamma judgment.

The preset gamma value ranges from 2.0 to 2.4. When the gamma value is within the preset gamma value range, it is determined that the gamma value adjustment is successful. When the gamma value is not within the preset gamma value range, it is determined that the gamma value adjustment fails. When the gamma value adjustment is successful, the prompt message is directly output, indicating a successful gamma curve adjustment; when the gamma value adjustment fails, the prompt message is directly output indicating a failed gamma value adjustment.

Understandably, there may be cases where the stored gamma value is damaged or the storage may fail. When the adjusting file is not obtained, a prompt message may be output indicating that the adjusting file does not exist.

When the judgment instruction of the display panel is detected, the panel information can be obtained of the display panel to be judged. The corresponding adjusting file can be obtained according to the panel information, and the corresponding gamma value can be obtained according to the adjusting file. Which is, the Step S40 includes obtaining the panel information of the display panel to be judged; and extracting the adjusting file corresponding to the panel information. It can be understood that the already-called adjusting file can be added with the "already-called" identification, which can be preferentially deleted if necessary.

It is acquired that a judgment result and the panel information of the display panel of which the gamma value is judged, after the gamma judgment of the display panel is performed. And the judgment result and the panel information are associated and stored. The judgment result and the panel information can be sent to a server.

In the technical solution of the embodiments, the adjusting file is directly obtained from the preset storing path to perform gamma value judgment, so that a user is avoid of manually inputting the gamma values to perform the gamma value judgment, and the efficiency is improved.

Figure 4:
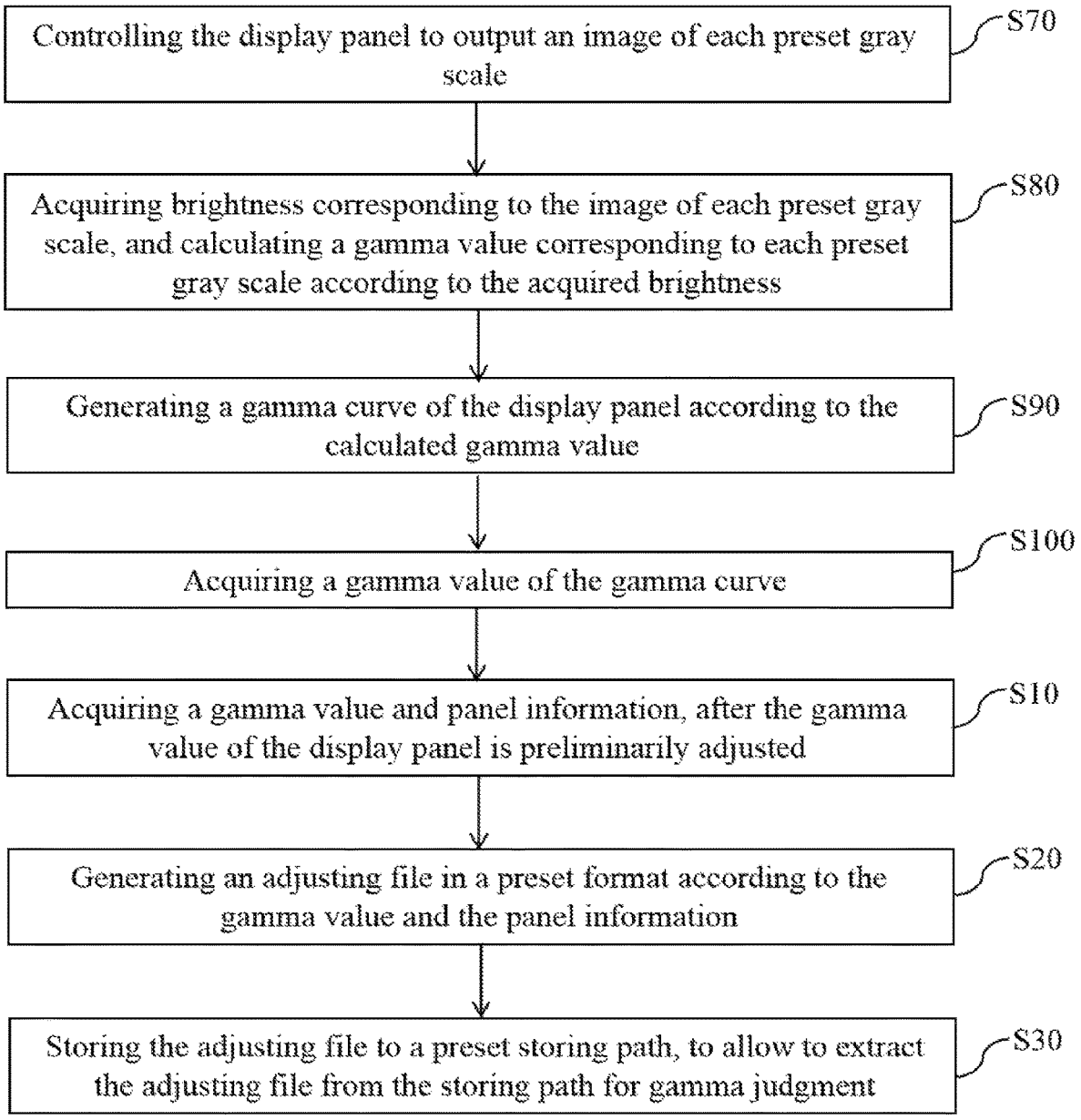
FIG. 4 is a flow chart of an adjusting method for a gamma value in some different embodiments of the present application.

Optionally, in some different embodiments, FIG. 4 is referred to. Some other embodiments regarding the adjusting method is proposed for the gamma value of the display panel of the present application, based on some embodiments. In some different embodiments, before Step S10, the adjusting method for the gamma value of the display panel further includes:

Step S70, controlling the display panel to output an image of each preset gray scale;

Step S80, acquiring brightness corresponding to the image of each preset gray scale, and calculating a gamma value corresponding to each preset gray scale according to the acquired brightness;

Step S90, generating a gamma curve of the display panel according to the calculated gamma value; and Step S100, acquiring a gamma value of the gamma curve.

The controller can sequentially transmit images of 255 gray scales to the display screen. In order to avoid too many detecting points, the controller can take every preset gray scale with a preset number (e.g., 4 gray scales) as a detecting point and output a gray scale image corresponding to the detecting point. The display panel displays the received image after receiving the image and collects the brightness of the image, which is detected by a brightness meter or detection software. After detecting the brightness, the brightness is converted into transmittance, and the gray scale is expressed as a percentage. Then, the gamma value corresponding to each point is calculated by taking logarithm of the percentage. If the calculated gamma value is not within the range of 2.0-2.4, calibration can be carried out again.

The coordinate system of the gamma curve is formed by the transmittance and gray scale, the calculated gamma value is marked in a preset coordinate system after calculation, and a gamma curve is formed by connecting each gamma value. Due to the limited number of images detected, the curve formed after connecting the gamma values may not be smooth enough, and inflection points may appear. For above, the inflection points may be processed to be smooth.

The smoothing method may include adding detecting points, and connecting the curves according to the gamma values calculated from the added detecting points.

After the gamma value adjustment, some gamma values may not be within the preset range, such as 2.0-2.4. For above, the gamma curve is compared with the standard gamma curve after being generated. When there is an error between the gamma curve and the standard gamma curve, the output voltage of the backlight is adjusted.

After the gamma curve is generated, the standard transmittance can be calculated from the standard gray scale and the standard gamma value to obtain the standard gamma curve. The transmittance under each gray scale is compared with the standard transmittance to obtain an offset value of the transmittance, and the voltage adjustment value can be obtained according to the offset value of the transmittance. If the transmittance is too high, the gamma voltage needs to be reduced, and if the transmittance is too low, the gamma voltage value needs to be increased. The gamma voltage adjustment can be divided into two modes: symmetrical voltage adjustment mode and asymmetrical voltage adjustment mode. After obtaining the final gamma voltage, the gamma voltage can be obtained by adjusting the setting of the gamma register.

When the gamma value of the gamma curve is to be obtained, the averaged gamma value within the preset gray scale range can be obtained, such as obtaining the gamma average value within the gray scale range of 50-200, judging the average gamma value as the gamma value of the gamma curve, etc.

In addition, the present application further provides an adjusting device for a gamma value of a display panel, including at least one processor and a memory, in which the memory stores computer executable instructions executable by the at least one processor, and when the computer executable instructions are executed by the at least one processor, operations are executed in the following circuit:

an acquiring circuit, configured to acquire a gamma value and panel information, after the gamma value of the display panel is preliminarily adjusted;

a generating circuit, configured to generate an adjusting file in a preset format according to the gamma value and the panel information; and a storing circuit, configured to store the adjusting file to a preset storing path, to allow to extract the adjusting file from the storing path for gamma judgment.

Optionally, in some embodiments, when the computer executable instructions are executed by the at least one processor, operations are further executed in the following circuit:

a file extracting circuit, configured to extract the adjusting file of the display panel from the preset storing path;

a gamma value acquiring circuit, configured to acquire the gamma value in the adjusting file; and a judging circuit, configured to judge whether the gamma value is in a preset gamma value range, to perform the gamma judgment.

In addition, the present application further provides a display apparatus, in which the display apparatus includes at least one processor and a memory, in which the memory stores computer executable instructions executable by the at least one processor, and when the computer executable instructions are executed by the at least one processor, operations are executed in the following circuit:

an outputting circuit, configured to control the display panel to output an image of each preset gray scale;

an acquiring circuit, configured to acquire brightness corresponding to the images of each preset gray scale;

a calculating circuit, configured to calculate a gamma value according to the brightness; and a comparing circuit, configured to compare the calculated gamma value with a preset gamma value range to determine whether a gamma value adjustment is correct, in which when the calculated gamma value is within the preset gamma value range, the gamma value adjustment is determined to be correct.

Optionally, in some embodiments, when the computer executable instructions are executed by the at least one processor, operations are further executed in the following circuit:

a file extracting circuit, configured to extract the adjusting file of the display panel from the preset storing path;

a gamma value acquiring circuit, configured to acquire the gamma value in the adjusting file; and a judging circuit, configured to judge whether the gamma value is in a preset gamma value range, to perform the gamma judgment.

It should be noted that in this file, the terms "comprising" "including" or any other variation thereof are intended to cover a non-exclusive inclusion, such that a process, method, article, or system that includes a list of elements includes not only those elements but further other elements not expressly listed, or elements inherent to such process, method, article, or system. Without further restrictions, an element defined by the statement "includes an" does not exclude the presence of another identical element in a process, method, article, or system including the element.

The aforementioned serial numbers regarding the embodiments of the present application are for description only and do not represent the superiority and inferiority of the embodiments.

From the above description of the embodiments, those skilled in the art can clearly understand that the method of the above embodiments can be implemented by means of software plus necessary general-purpose hardware platforms. Of course, it can further be implemented by means of hardware, but in many cases the former is a better embodiment. Based on this understanding, the technical solution of the present application, in essence, or the part contributing to the prior art, can be embodied in the form of a software product stored in a storage medium (such as ROM/RAM, magnetic disk, diskette) as described above, including several instructions to cause a terminal device (which can be a mobile phone, computer, server, controlled terminal, or network device, etc.) to perform the methods described in various embodiments of the present application.

The description aforementioned is only the optional embodiment of the present application and is not intended to limit the scope of the present application. Any equivalent structural or flow modification made by using the description and drawings of the present application or direct/indirect application in other related technical fields under the concept of the present application shall be included in the protection scope of the present application.

What is claimed is:

1. An adjusting method for a gamma value of a display panel, comprising:

controlling the display panel to output an image of each preset gray scale;

acquiring brightness corresponding to the image of each preset gray scale, and calculating a gamma value corresponding to each preset gray scale according to the acquired brightness;

generating a gamma curve of the display panel according to the calculated gamma value;

acquiring a gamma value of the gamma curve;

acquiring an adjusted gamma value and panel information, after the gamma value of the display panel is adjusted;

generating an adjusting file in a preset format according to the adjusted gamma value and the panel information; and storing the adjusting file to a preset storing path, to allow to extract the adjusting file from the storing path for gamma judgment.

2. The adjusting method of claim 1, wherein the adjusting file in the preset format is a text file named after panel identification and an adjusting time point.

3. The adjusting method of claim 1, wherein after storing the adjusting file to a preset storing path, the method further comprises:

extracting the adjusting file of the display panel from the preset storing path;

acquiring the adjusted gamma value in the adjusting file; and judging whether the adjusted gamma value is in a preset gamma value range, to perform the gamma judgment.

4. The adjusting method of claim 3, wherein extracting the adjusting file of the display panel from the preset storing path, comprises:

acquiring panel information of the display panel to be judged; and extracting the adjusting file correspondingly according to the acquired panel information.

5. The adjusting method of claim 3, wherein after extracting the adjusting file of the display panel from the preset storing path, the method further comprises:

outputting a prompt message indicating that the adjusting file does not exist, when the adjusting file is not obtained.

6. The adjusting method of claim 3, wherein after extracting the adjusting file of the display panel from the preset storing path, the method further comprises:

adding an "already-called" identification to the extracted adjusting file.

7. The adjusting method of claim 1, wherein acquiring a gamma value of the gamma curve, comprises:

acquiring an average gamma value in a preset gray scale range; and taking the average gamma value as the gamma value of the gamma curve.

8. The adjusting method of claim 1, wherein controlling the display panel to output an image of each preset gray scale, comprises:

taking a detecting point for each preset gray scale interval, and outputting the image of the gray scale corresponding to each detecting point.

9. The adjusting method of claim 1, wherein generating a gamma curve of the display panel according to the calculated gamma value, comprises:

connecting the calculated gamma value to form a curve; and smoothing an inflection point on the curve to obtain the gamma curve.

10. The adjusting method of claim 1, wherein after generating a gamma curve of the display panel according to the calculated gamma value, the method further comprises:

adjusting an output voltage of backlight, when an error exists between the gamma curve and a standard gamma curve.

11. The adjusting method of claim 1, further comprising:

acquiring a judgment result and the panel information of the display panel of which the adjusted gamma value is judged, after the gamma judgment of the display panel is performed; and associating and storing the judgment result and the panel information.

12. The adjusting method of claim 11, wherein after acquiring a judgment result and the panel information of the display panel of which the adjusted gamma value is judged, the method further comprises:

sending the judgment result and the panel information to a server.

13. The adjusting method of claim 1, wherein the panel information comprises a panel identification, a panel model and/or an adjusting time point.

14. The adjusting method of claim 1, wherein the adjusting file is categorized to store according to a panel model.

15. The adjusting method of claim 1, wherein a preset number of the adjusting file is deleted based on a storing time point, when remaining storage capacity regarding the storing path is less than a preset threshold value; or, a preset number of the adjusting file is deleted at a preset time interval.

16. An adjusting device for a gamma value of a display panel, wherein the adjusting device comprises at least one processor and a memory, wherein the memory stores computer executable instructions executable by the at least one processor, and when the computer executable instructions are executed by the at least one processor, following operations are executed:

controlling the display panel to output an image of each preset gray scale;

acquiring brightness corresponding to the image of each preset gray scale, and calculating a gamma value corresponding to each preset gray scale according to the acquired brightness;

generating a gamma curve of the display panel according to the calculated gamma value;

acquiring a gamma value of the gamma curve;

acquiring an adjusted gamma value and panel information, after the gamma value of the display panel is adjusted;

generating an adjusting file in a preset format according to the adjusted gamma value and the panel information; and storing the adjusting file to a preset storing path, to allow to extract the adjusting file from the storing path for gamma judgment.

17. The adjusting device of claim 16, wherein, when the computer executable instructions are executed by the at least one processor, operations are further executed:

extracting the adjusting file of the display panel from the preset storing path;

acquiring the adjusted gamma value in the adjusting file; and judging whether the adjusted gamma value is in a preset gamma value range, to perform the gamma judgment.

18. A display apparatus, wherein the display apparatus comprises at least one processor and a memory, the memory storing computer executable instructions executable by the at least one processor, and when the computer executable instructions are executed by the at least one processor, following operations being executed:

controlling the display panel to output an image of each preset gray scale;

acquiring brightness corresponding to the image of each preset gray scale, and calculating a gamma value corresponding to each preset gray scale according to the acquired brightness;

generating a gamma curve of the display panel according to the calculated gamma value;

acquiring a gamma value of the gamma curve;

acquiring an adjusted gamma value and panel information, after the gamma value of the display panel is adjusted;

generating an adjusting file in a preset format according to the gamma value and the panel information; and storing the adjusting file to a preset storing path, to allow to extract the adjusting file from the storing path for gamma judgment.

19. The display apparatus of claim 18, wherein, when the computer executable instructions are executed by the at least one processor, operations are further executed:

extracting the adjusting file of the display panel from the preset storing path;

acquiring the adjusted gamma value in the adjusting file; and judging whether the adjusted gamma value is in a preset gamma value range, to perform the gamma judgment.

* * * * *